US009855593B2

(12) United States Patent
Ishizuka et al.

(10) Patent No.: US 9,855,593 B2
(45) Date of Patent: Jan. 2, 2018

(54) MOLDING APPARATUS, METHOD FOR REPLACING COMPONENTS OF MOLDING APPARATUS, AND REPLACEMENT UNIT FOR MOLDING APPARATUS

(71) Applicant: SUMITOMO HEAVY INDUSTRIES, LTD., Tokyo (JP)

(72) Inventors: Masayuki Ishizuka, Ehime (JP); Masayuki Saika, Ehime (JP); Norieda Ueno, Kanagawa (JP); Takashi Komatsu, Tochigi (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/383,850

(22) Filed: Dec. 19, 2016

(65) Prior Publication Data

US 2017/0095854 A1 Apr. 6, 2017

Related U.S. Application Data

(63) Continuation of application No. PCT/JP2015/067713, filed on Jun. 19, 2015.

(30) Foreign Application Priority Data

Jun. 19, 2014 (JP) ..... 2014-126376

(51) Int. Cl.

| | |
|---|---|
| ***B01D 37/04*** | (2006.01) |
| ***B21D 26/047*** | (2011.01) |
| ***B21D 22/12*** | (2006.01) |
| ***B21D 26/039*** | (2011.01) |
| ***B21D 26/025*** | (2011.01) |

(Continued)

(52) U.S. Cl.

CPC ..... *B21D 26/047* (2013.01); *B21C 37/154* (2013.01); *B21D 22/12* (2013.01);

(Continued)

(58) Field of Classification Search

CPC .... B21D 26/039; B21D 26/02; B21D 26/025; B21D 22/12; B21D 26/047; B21D 37/04; B21C 37/154; C21D 1/673

(Continued)

(56) References Cited

U.S. PATENT DOCUMENTS 5,600,983 A * 2/1997 Rigsby ..... B21C 37/154 29/421.1
6,536,251 B2 * 3/2003 Marando ..... B21D 26/025 72/455

(Continued)

FOREIGN PATENT DOCUMENTS

JP H10-156429 A 6/1998
JP 2000-271664 A 10/2000

(Continued)

OTHER PUBLICATIONS

International Search Report issued in Application No. PCT/JP2015/067713, dated Jul. 21, 2015.

(Continued)

*Primary Examiner* — David B. Jones
(74) *Attorney, Agent, or Firm* — Michael Best & Friedrich LLP

(57) ABSTRACT

A molding apparatus for molding a metal pipe includes: a gas supply unit which supplies gas into a heated metal pipe material, thereby expanding the metal pipe material; a mold which molds the metal pipe by bringing the expanded metal pipe material into contact therewith; and a drive unit which generates a driving force for moving the mold, in which a replacement unit is replaceably provided with respect to a main body unit having at least the drive unit, and the replacement unit is configured of at least the gas supply unit and the mold.

5 Claims, 8 Drawing Sheets

(51) Int. Cl.

| | |
|---|---|
| ***B21C 37/15*** | (2006.01) |
| ***B21D 26/02*** | (2011.01) |
| ***C21D 1/673*** | (2006.01) |
| ***B21D 37/04*** | (2006.01) |

(52) U.S. Cl.
CPC ..... *B21D 26/02* (2013.01); *B21D 26/025* (2013.01); *B21D 26/039* (2013.01); *B21D 37/04* (2013.01); *C21D 1/673* (2013.01)

(58) Field of Classification Search
USPC ..... 72/61
See application file for complete search history.

(56) References Cited

U.S. PATENT DOCUMENTS

| | | | | |
|---|---|---|---|---|
| 6,892,560 | B2 * | 5/2005 | Hiramatsu | B21D 26/039 29/421.1 |
| 7,047,780 | B2 * | 5/2006 | Marando | B21D 26/02 72/455 |
| 7,509,827 | B2 * | 3/2009 | Hellgren | B21D 26/039 72/58 |
| 2002/0003011 | A1 | 1/2002 | Dykstra et al. | |
| 2004/0040636 | A1 | 3/2004 | Watanabe et al. | |

FOREIGN PATENT DOCUMENTS

| | | | |
|---|---|---|---|
| JP | 2003-154415 | A | 5/2003 |
| JP | 2004-249309 | A | 9/2004 |
| JP | 2004-276076 | A | 10/2004 |
| JP | 2009-220141 | A | 10/2009 |
| JP | 2013-059769 | A | 4/2013 |

OTHER PUBLICATIONS

Office Action issued in Canadian Patent Application No. 2,952,325, dated Feb. 2, 2017.

* cited by examiner

MOLDING APPARATUS, METHOD FOR REPLACING COMPONENTS OF MOLDING APPARATUS, AND REPLACEMENT UNIT FOR MOLDING APPARATUS

RELATED APPLICATIONS

Priority is claimed to Japanese Patent Application No. 2014-126376, filed Jun. 19, 2014, and International Patent Application No. PCT/JP2015/067713, the entire content of each of which is incorporated herein by reference.

BACKGROUND

Technical Field

Certain embodiments of the present invention relate to a molding apparatus which molds a metal pipe, a method for replacing components of a molding apparatus, and a replacement unit for a molding apparatus.

Description of Related Art

In the related art, a molding apparatus is known which performs molding by expanding a heated metal pipe material by supplying gas into the heated metal pipe material. For example, a molding apparatus shown in the related art is provided with an upper mold and a lower mold which are paired with each other, a holding section which holds a metal pipe material between the upper mold and the lower mold, and a gas supply unit which supplies gas into the metal pipe material held by the holding section. In this molding apparatus, it is possible to mold the metal pipe material into a shape corresponding to the shape of a mold by expanding the metal pipe material by supplying gas into the metal pipe material in a state of being held between the upper mold and the lower mold.

SUMMARY

According to an embodiment of the present invention, there is provided a molding apparatus that molds a metal pipe, including: a gas supply unit which supplies gas into a heated metal pipe material, thereby expanding the metal pipe material; a mold which molds the metal pipe by bringing the expanded metal pipe material into contact therewith; and a drive unit which generates a driving force for moving the mold, in which a replacement unit is replaceably provided with respect to a main body unit having at least the drive unit, and the replacement unit is configured of at least the gas supply unit and the mold.

According to another embodiment of the present invention, there is provided a method for replacing components of a molding apparatus which includes a gas supply unit which supplies gas into a heated metal pipe material, thereby expanding the metal pipe material, a mold which molds a metal pipe by bringing the expanded metal pipe material into contact therewith, and a drive unit which generates a driving force for moving the mold, the method including: configuring a replacement unit by at least the gas supply unit and the mold; and replacing the replacement unit provided with respect to a main body unit having at least the drive unit.

According to still another embodiment of the present invention, there is provided a replacement unit for a molding apparatus, which is used in a molding apparatus that molds a metal pipe, including: a gas supply unit which supplies gas into a heated metal pipe material, thereby expanding the metal pipe material; a mold which molds the metal pipe by bringing the expanded metal pipe material into contact therewith; and a base member to which the gas supply unit and the mold are connected, in which the replacement unit is replaceably provided with respect to a main body unit of the molding apparatus.

BRIEF DESCRIPTION OF THE DRAWINGS

FIGS. 3A and 3B are diagrams showing a manufacturing process by the molding apparatus, in which FIG. 3A is a diagram showing a state where a metal pipe material has been set in a mold and FIG. 3B is a diagram showing a state where the metal pipe material is held by electrodes.

FIGS. 5A to 5C are enlarged views of the surroundings of the electrode, in which FIG. 5A is a diagram showing a state where the electrode holds the metal pipe material, FIG. 5B is a diagram showing a state where a blowing mechanism is in contact with the electrode, and FIG. 5C is a front view of the electrode.

DETAILED DESCRIPTION

Figure 1:
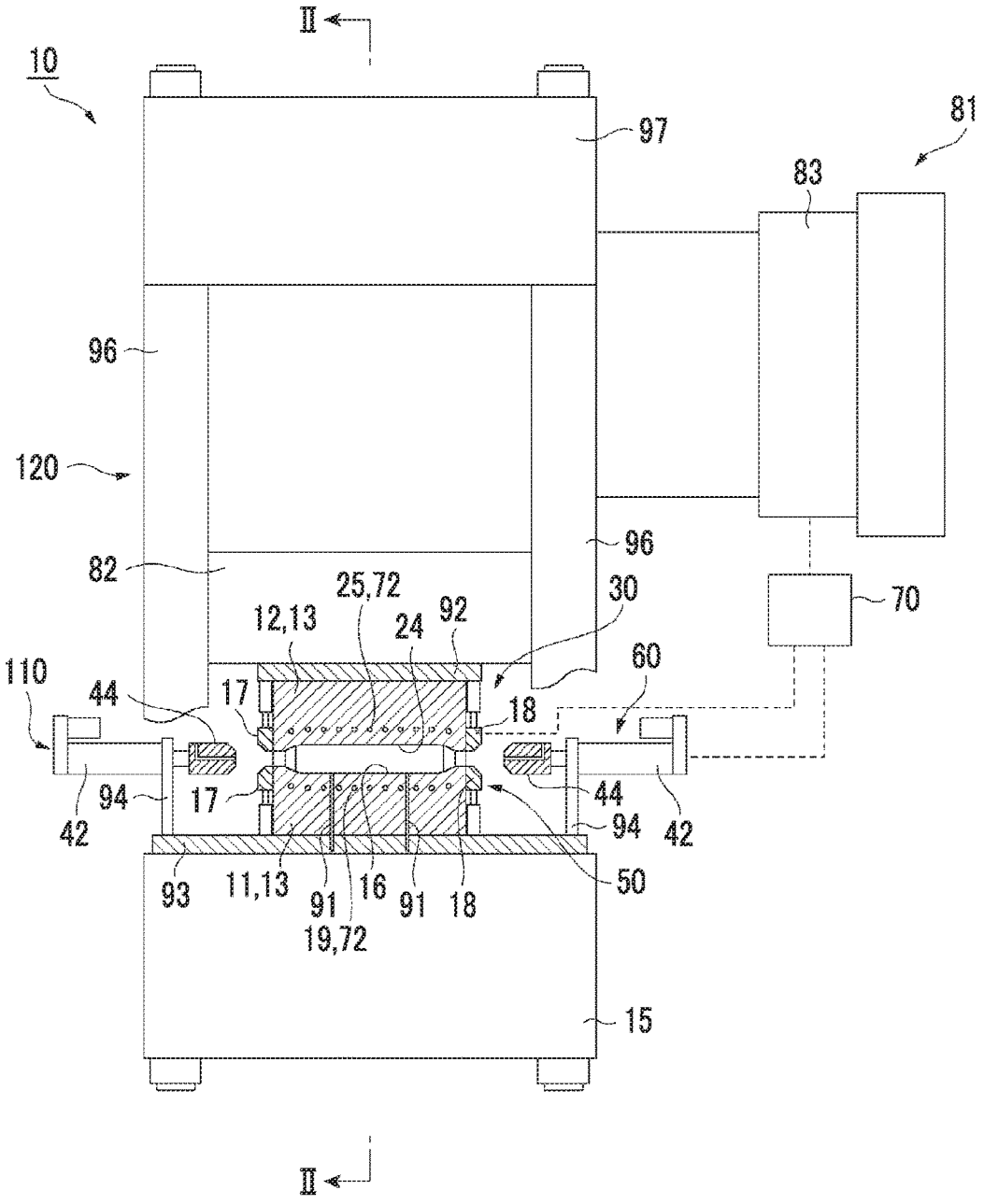
FIG. 1 is a schematic configuration diagram of a molding apparatus according to an embodiment of the present invention.

In the molding apparatus of the related art, in a case of changing the shape of a molding product, it is necessary to replace a mold. Further, in a case of replacing the mold, it is also necessary to replace other components of the surroundings of the mold, such as the holding section, accordingly. Therefore, a lot of time is required for replacement of components, and therefore, it is required to shorten the time which is required for replacement of components.

It is desirable to provide a molding apparatus, a method for replacing components of a molding apparatus, and a replacement unit for a molding apparatus, in which it is possible to perform component replacement in a short time.

In the molding apparatus according to an embodiment of the present invention, the replacement unit is replaceably provided with respect to the main body unit having at least the drive unit. Further, the replacement unit is configured of at least the gas supply unit and the mold. Due to such a configuration, when replacing the mold of the molding apparatus, it is possible to replace every replacement unit with respect to the main body unit. The gas supply unit which needs to be replaced according to the mold replacement can also be replaced. By the above, it is possible to perform replacement of components in a short time.

Further, in the molding apparatus according to an embodiment of the present invention, in the replacement unit, the gas supply unit and the mold may be connected to a base member. Due to such a configuration, it is possible to unitize each component in a simple configuration.

According to the method for replacing components of a molding apparatus according to another embodiment of the present invention, it is possible to obtain the same operation and effects as those of the molding apparatus described above.

Further, the method for replacing components of a molding apparatus according to another embodiment of the present invention may further include: a step of removing the replacement unit provided with respect to the main body unit; a step of recovering the removed replacement unit by a first dolly; a step of transporting a new replacement unit by the first dolly; and a step of providing the new replacement unit in the main body unit. In this way, it becomes possible to replace the replacement unit by a single dolly, and therefore, it is possible to replace the replacement unit with a simple system configuration.

Further, the method for replacing components of a molding apparatus according to another embodiment of the present invention may further include: a step of removing the replacement unit provided with respect to the main body unit; a step of recovering the removed replacement unit by a first dolly; a step of transporting a new replacement unit by a second dolly; and a step of providing the new replacement unit in the main body unit. In this way, the replacement unit is recovered by the first dolly, and on the other hand, it is possible to transport the new replacement unit by the second dolly and provide the new replacement unit in the main body unit. Therefore, it becomes possible to quickly perform the work of replacing the replacement unit.

The replacement unit for a molding apparatus according to still another embodiment of the present invention is configured of at least the gas supply unit, the mold, and the base member. Due to such a configuration, when replacing the mold of the molding apparatus, it is possible to replace every replacement unit for a molding apparatus with respect to the main body unit. The gas supply unit which needs to be replaced according to the mold replacement can also be replaced. By the above, it is possible to perform replacement of components in a short time.

<Configuration of Molding Apparatus>

Figure 2A:
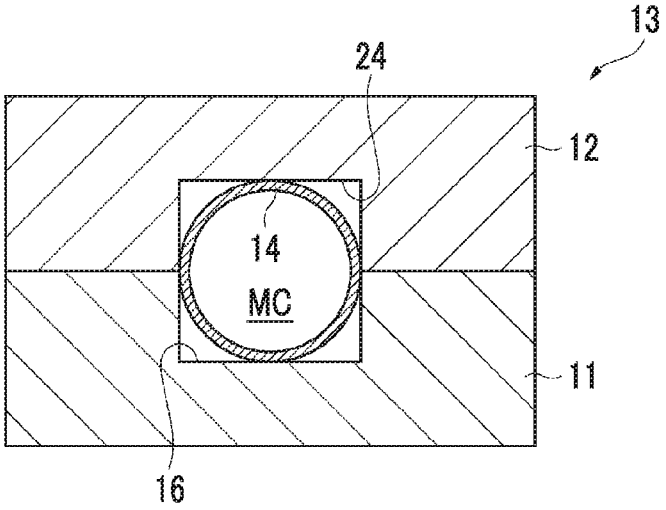
FIGS. 2A and 2B are cross-sectional views taken along line II-II shown in FIG. 1 and are schematic cross-sectional views of a blow molding mold.
Figure 2B:
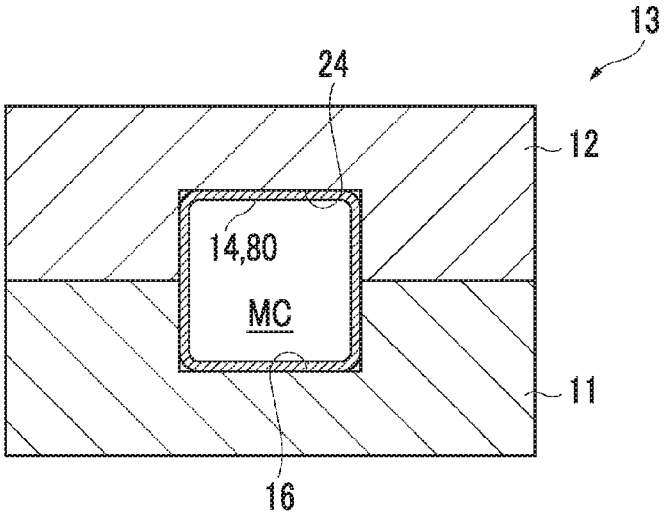

As shown in FIGS. 1, 2A, and 2B, a molding apparatus 10 which molds a metal pipe is configured to include: a blow molding mold (a mold) 13 which is composed of an upper mold 12 and a lower mold 11; a slide 82 which moves at least one of the upper mold 12 and the lower mold 11; a drive unit 81 which generates a driving force for moving the slide 82; a pipe holding mechanism 30 which horizontally holds a metal pipe material 14 between the upper mold 12 and the lower mold 11; a heating mechanism (a heating section) 50 which energizes and heats the metal pipe material 14 held by the pipe holding mechanism 30; a blowing mechanism (a gas supply unit) 60 which blows high-pressure gas into the heated metal pipe material 14; a control unit 70 which controls the drive unit 81, the pipe holding mechanism 30, an operation of the blow molding mold 13, the heating mechanism 50, and the blowing mechanism 60; and a water circulation mechanism 72 which forcibly water-cools the blow molding mold 13. The control unit 70 performs a series of control such as closing the blow molding mold 13 when the metal pipe material 14 has been heated to a quenching temperature (a temperature higher than or equal to an AC3 transformation point temperature) and blowing high-pressure gas into the heated metal pipe material 14. In the following description, a pipe after molding is referred to as a metal pipe 80 (refer to FIG. 2B), and a pipe in a stage on the way to lead to completion is referred to as the metal pipe material 14.

Figure 5A:
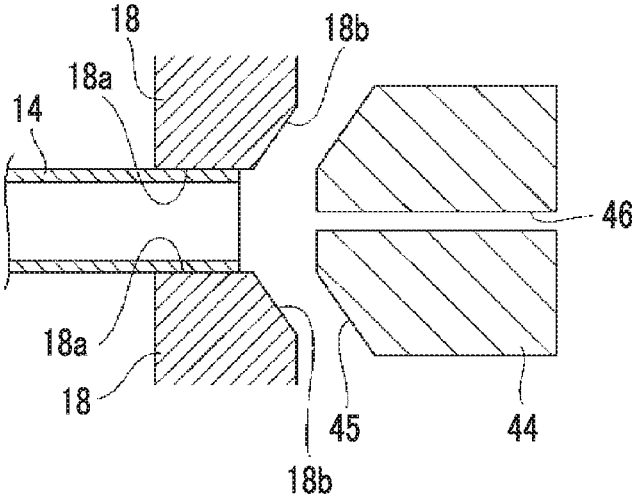
Figure 5B:
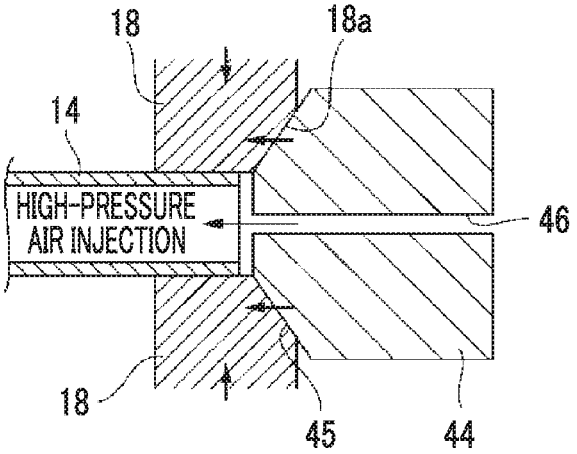
Figure 5C:
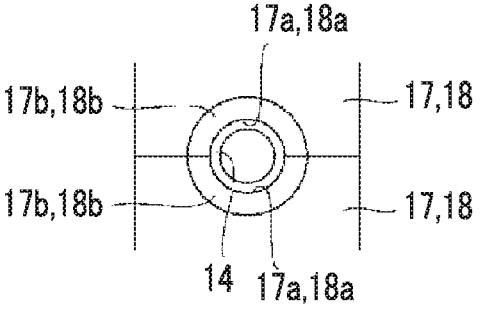

The lower mold 11 is fixed to a large base 15 through a base member 93. Further, the lower mold 11 is configured of a large steel block and has a cavity (a recessed portion) 16 formed in the upper surface thereof. Further, a first electrode 17 and a second electrode 18 which are configured so as to be able to be advanced and retreated up and down by an actuator are provided in the vicinity of right and left ends (right and left ends in FIG. 1) of the lower mold 11. Semicircular arc-shaped concave grooves 17*a* and 18*a* corresponding to the lower-side outer peripheral surface of the metal pipe material 14 are formed in the upper surfaces of the first and second electrodes 17 and 18 (refer to FIG. 5C), and the metal pipe material 14 can be placed so as to be exactly fitted to the portions of the concave grooves 17*a* and 18*a*. Further, tapered concave surfaces 17*b* and 18*b* recessed to be inclined in a tapered shape in circumference toward the concave grooves 17*a* and 18*a* are formed in the front faces (the faces in an outward direction of a mold) of the first and second electrodes 17 and 18 (refer to FIG. 5C). Further, a cooling water passage 19 is formed in the lower mold 11. Further, a pin 91 of an ejector is inserted into the lower mold 11. A lower end section of the pin 91 is connected to a cylinder (not shown) provided in the base 15. The pin 91 may be configured as a thermocouple which measures the temperature of the metal pipe material 14. Further, the thermocouple merely illustrates an example of temperature measuring means, and a non-contact type temperature sensor such as a radiation thermometer or an optical thermometer is also acceptable. Further, as long as the correlation between an energization time and a temperature is obtained, it is also sufficiently possible to make a configuration with the temperature measuring means omitted.

Further, a pair of first and second electrodes 17 and 18 which is located on the lower mold 11 side also serves as the pipe holding mechanism 30 and can horizontally support the metal pipe material 14 such that the metal pipe material 14 can move up and down between the upper mold 12 and the lower mold 11.

The upper mold 12 is a large steel block having a cavity (a recessed portion) 24 formed in the lower surface thereof, and having a cooling water passage 25 formed therein. The upper mold 12 is fixed to the slide 82 through a die holder 92 at an upper end portion thereof. The drive unit 81 according to this embodiment is provided with a servomotor 83 which generates a driving force for moving the slide 82. The servomotor 83 is connected to an eccentric shaft (not shown) through a speed reducer. The eccentric shaft is connected to a converter (not shown) which converts rotational motion into eccentric motion in a vertical direction. The converter is connected to the slide 82. Due to such a structure, the slide 82 moves in an up-and-down direction according to the rotation of the eccentric shaft. The drive unit 81 is not limited to the configuration using the eccentric shaft, as described above, and for example, as long as the drive unit is mechanically connected to the slide 82 to directly or indirectly apply a driving force generated by the servomotor 83 to the slide 82, any configuration is also acceptable, and the drive unit may apply a driving force to the slide 82 through a pressurizing cylinder or the like. Further, in this embodiment, only the upper mold 12 moves. However, a configuration is also acceptable in which in addition to the upper mold 12 or instead of the upper mold 12, the lower mold 11 moves.

Further, a first electrode 17 and a second electrode 18 which are configured so as to be able to be advanced and retreated up and down by an actuator are provided in the vicinity of right and left ends (right and left ends in FIG. 1) of the upper mold 12, similar to the lower mold 11. Semicircular arc-shaped concave grooves 17*a* and 18*a* corresponding to the upper-side outer peripheral surface of the metal pipe material 14 are formed in the lower surfaces of the first and second electrodes 17 and 18 (refer to FIG. 5C), and the metal pipe material 14 can be exactly fitted to the concave grooves 17*a* and 18*a*. Further, tapered concave surfaces 17*b* and 18*b* recessed to be inclined in a tapered shape in circumference toward the concave grooves 17*a* and 18*a* are formed in the front faces (the faces in the outward direction of the mold) of the first and second electrodes 17 and 18 (refer to FIG. 5C). That is, a configuration is made such that, if the metal pipe material 14 is gripped by the upper and lower pairs of first and second electrodes 17 and 18 from the up-and-down direction, the outer circumference of the metal pipe material 14 can be exactly surrounded in a close contact manner over the entire circumference.

Further, the first electrode 17 and the second electrode 18 are connected to an electric power supply (not shown) and supply electric power to the metal pipe material 14, thereby heating the metal pipe material 14. Therefore, the heating mechanism 50 is configured of the first electrode 17 and the second electrode 18.

FIGS. 2A and 2B are schematic cross-sections when the blow molding mold 13 is viewed from a side direction. These are cross-sectional views of the blow molding mold 13 taken along line II-II in FIG. 1 and show the state of a mold position at the time of blow molding. As shown in FIGS. 2A and 2B, the rectangular recessed portion 16 is formed in the upper surface of the lower mold 11. In the lower surface of the upper mold 12, the rectangular recessed portion 24 is formed at a position facing the recessed portion 16 of the lower mold 11. In a state where the blow molding mold 13 is closed, the recessed portion 16 of the lower mold 11 and the recessed portion 24 of the upper mold 12 are combined, whereby a main cavity portion MC that is a rectangular space is formed. The metal pipe material 14 disposed in the main cavity portion MC, as shown in FIG. 2A, expands, thereby coming into contact with the inner wall surfaces of the main cavity portion MC and being molded into the shape (here, a rectangular cross-sectional shape) of the main cavity portion MC, as shown in FIG. 2B.

The blowing mechanism 60 is provided with a seal member 44 which supplies gas from an end portion of the metal pipe material 14, and a cylinder unit 42 which drives the seal member 44. The seal member 44 is connected to the cylinder unit 42 through a cylinder rod and is made so as to be able to advance and retreat in accordance with an operation of the cylinder unit 42. Further, the cylinder unit 42 is placed above and fixed to the base member 93 through a fixing member 94. Further, a leading end of the seal member 44 has a tapered surface 45 formed therein such that the leading end is tapered, and is configured in a shape capable of being exactly fitted to and brought into contact with the tapered concave surfaces 17*b* and 18*b* of the first and second electrodes (refer to FIGS. 5A to 5C). A pressure control valve (not shown) is connected to the cylinder unit 42, and the pressure control valve supplies high-pressure gas having an operating pressure adapted to a pushing force which is required from the seal member 44 side, to the cylinder unit 42.

The water circulation mechanism 72 pumps up water stored in a water tank (not shown) and pressurizes and sends the water to the cooling water passage 19 of the lower mold 11 and the cooling water passage 25 of the upper mold 12. A cooling tower which lowers a water temperature or a filter which purifies water may be interposed in each of pipes extending from the water tank to the cooling water passages 19 and 25.

<Operation of Molding Apparatus>

Figure 3A:
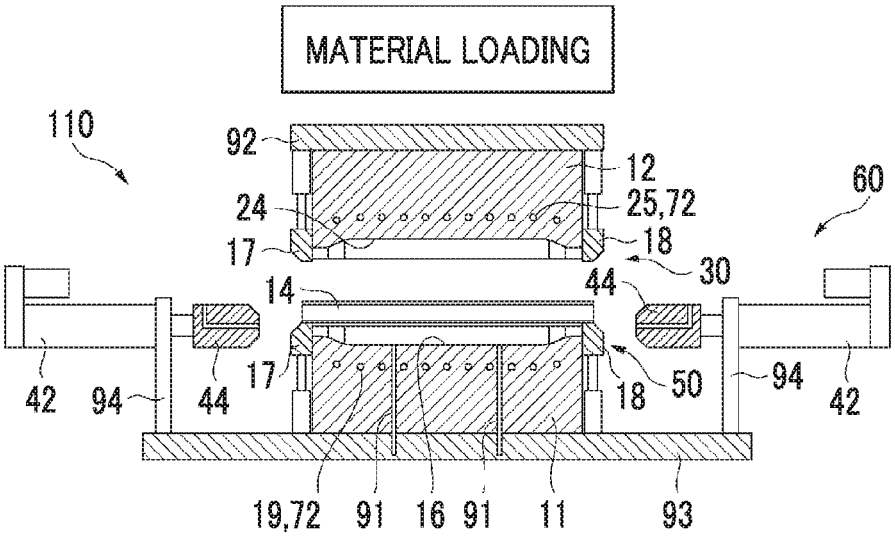
Figure 3B:
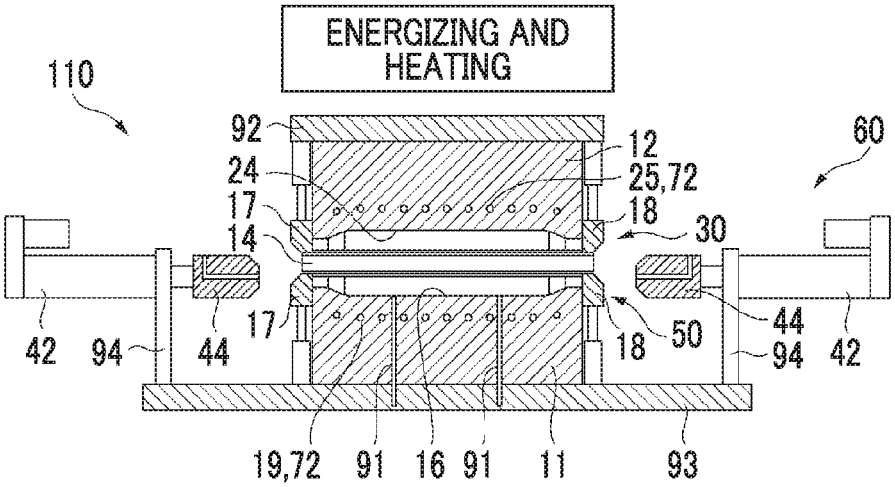

Next, an operation of the molding apparatus 10 will be described. FIGS. 3A and 3B show a manufacturing process from a pipe loading process of loading the metal pipe material 14 as a material to an energizing and heating process of energizing and heating the metal pipe material 14. As shown in FIG. 3A, the metal pipe material 14 having a steel grade capable of being quenched is prepared and the metal pipe material 14 is placed on the first and second electrodes 17 and 18 provided on the lower mold 11 side by using a robot arm (not shown) or the like. The concave grooves 17*a* and 18*a* are formed in the first and second electrodes 17 and 18, and therefore, the metal pipe material 14 is positioned by the concave grooves 17*a* and 18*a*. Next, the control unit 70 (refer to FIG. 1) controls the pipe holding mechanism 30 such that the pipe holding mechanism 30 holds the metal pipe material 14. Specifically, as in FIG. 3B, an actuator capable of advancing and retreating the respective electrodes 17 and 18 is operated, thereby making the first and second electrodes 17 and 18 which are located on each of the upper and lower sides approach each other and come into contact with each other. Due to this contact, both end portions of the metal pipe material 14 are gripped by the first and second electrodes 17 and 18 from above and below. Further, in this grip, the metal pipe material 14 is gripped in a close contact aspect over the entire circumference thereof due to the existence of the concave grooves 17*a* and 18*a* formed in the first and second electrodes 17 and 18. However, there is no limitation to the configuration in which close contact is performed over the entire circumference of the metal pipe material 14, and a configuration is also acceptable in which the first and second electrodes 17 and 18 come into contact with a portion in a peripheral direction of the metal pipe material 14.

Subsequently, the control unit 70 controls the heating mechanism 50 such that the heating mechanism 50 heats the metal pipe material 14. Specifically, the control unit 70 switches on a switch of the heating mechanism 50. Then, electric power is supplied from an electric power supply (not shown) to the metal pipe material 14 through the first and second electrodes 17 and 18, and the metal pipe material 14 itself generates heat (Joule heat) due to resistance which is present in the metal pipe material 14. In this case, the measurement value of a thermocouple is continuously monitored and energization is controlled based on the result.

Figure 4:
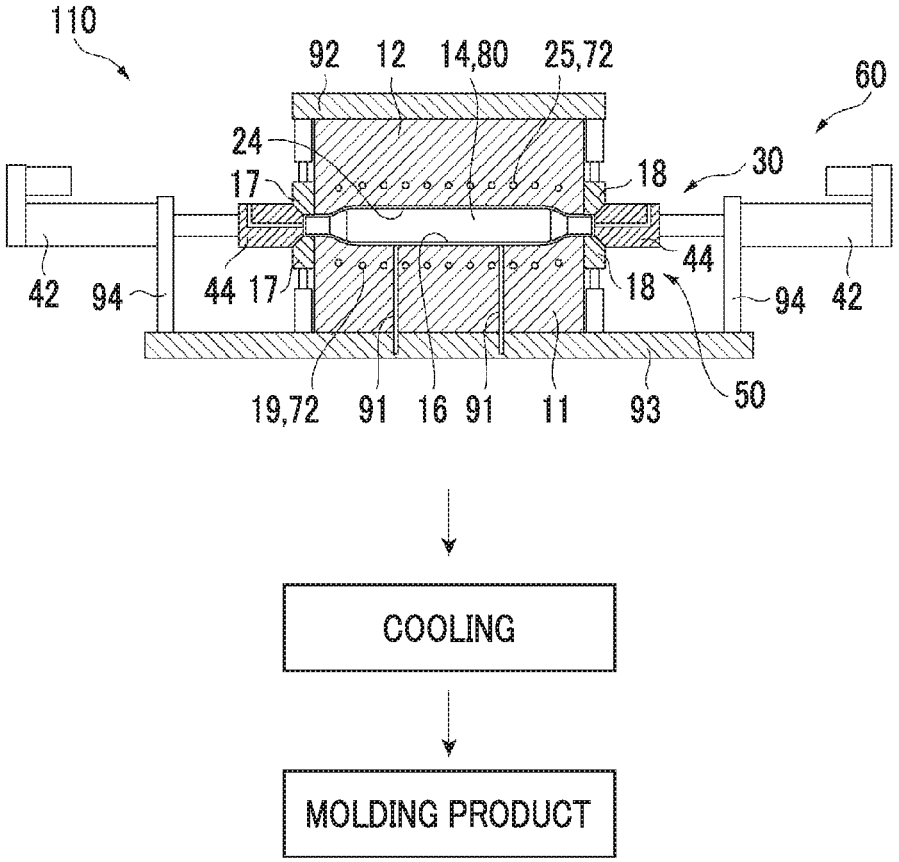
FIG. 4 is a diagram showing a blow molding process by the molding apparatus and the subsequent flow.

FIG. 4 shows blow molding and the processing content after the blow molding. Specifically, as shown in FIG. 4, the blow molding mold 13 is closed with respect to the metal pipe material 14 after the heating, and thus the metal pipe material 14 is disposed and hermetically sealed in the cavity of the blow molding mold 13. Thereafter, the cylinder units 42 are operated, thereby sealing both ends of the metal pipe material 14 by the seal members 44, each of which is a portion of the blowing mechanism 60 (also refer to FIGS. 5A to 5C together). The sealing is indirectly performed through the tapered concave surfaces 17*b* and 18*b* formed in the first and second electrodes 17 and 18, rather than being performed by direct contact of the seal members 44 with both end faces of the metal pipe material 14. By doing so, the sealing can be performed at the wide area, and therefore, seal performance can be improved, and in addition, wear of the seal member due to a repeated sealing operation is prevented and collapse or the like of both end faces of the metal pipe material 14 is effectively prevented. After the completion of the sealing, high-pressure gas is blown into the metal pipe material 14, whereby the metal pipe material 14 softened due to heating is deformed so as to conform to the shape of the cavity. Thereafter, if cooling is performed on the metal pipe 80 after the blow molding and thus quenching is performed, the molding of the metal pipe 80 is completed.

The metal pipe material 14 is softened by being heated to a high temperature (around 950° C.), and thus can be blow-molded with a relatively low pressure. Specifically, in a case where compressed air having a normal temperature (25° C.) at 4 MPa is adopted as the high-pressure gas, as a result, the compressed air is heated to around 50° C. in the hermetically-sealed metal pipe material 14. The compressed air thermally expands and reaches a pressure in a range of about 16 MPa to 17 MPa, based on the Boyle-Charles' Law. That is, it is possible to easily blow-mold the metal pipe material 14 having a temperature of 950° C.

Then, the outer peripheral surface of the blow-molded and swelled metal pipe material 14 is rapidly cooled in contact with the cavity 16 of the lower mold 11 and at the same time, is rapidly cooled in contact with the cavity 24 of the upper mold 12 (since the upper mold 12 and the lower mold 11 have large heat capacities and are managed to have a low temperature, if the metal pipe material 14 comes into contact therewith, the heat of the surface of the pipe is removed to the mold side at once), whereby quenching is performed. Such a cooling method is called mold contact cooling or mold cooling. Immediately after the rapid cooling, austenite is transformed into martensite. Since a cooling rate is reduced in the second half of the cooling, the martensite is transformed into another structure (troostite, sorbite, or the like) due to reheating. Therefore, it is not necessary to separately perform tempering treatment.

(Component Replacement)

Figure 6:
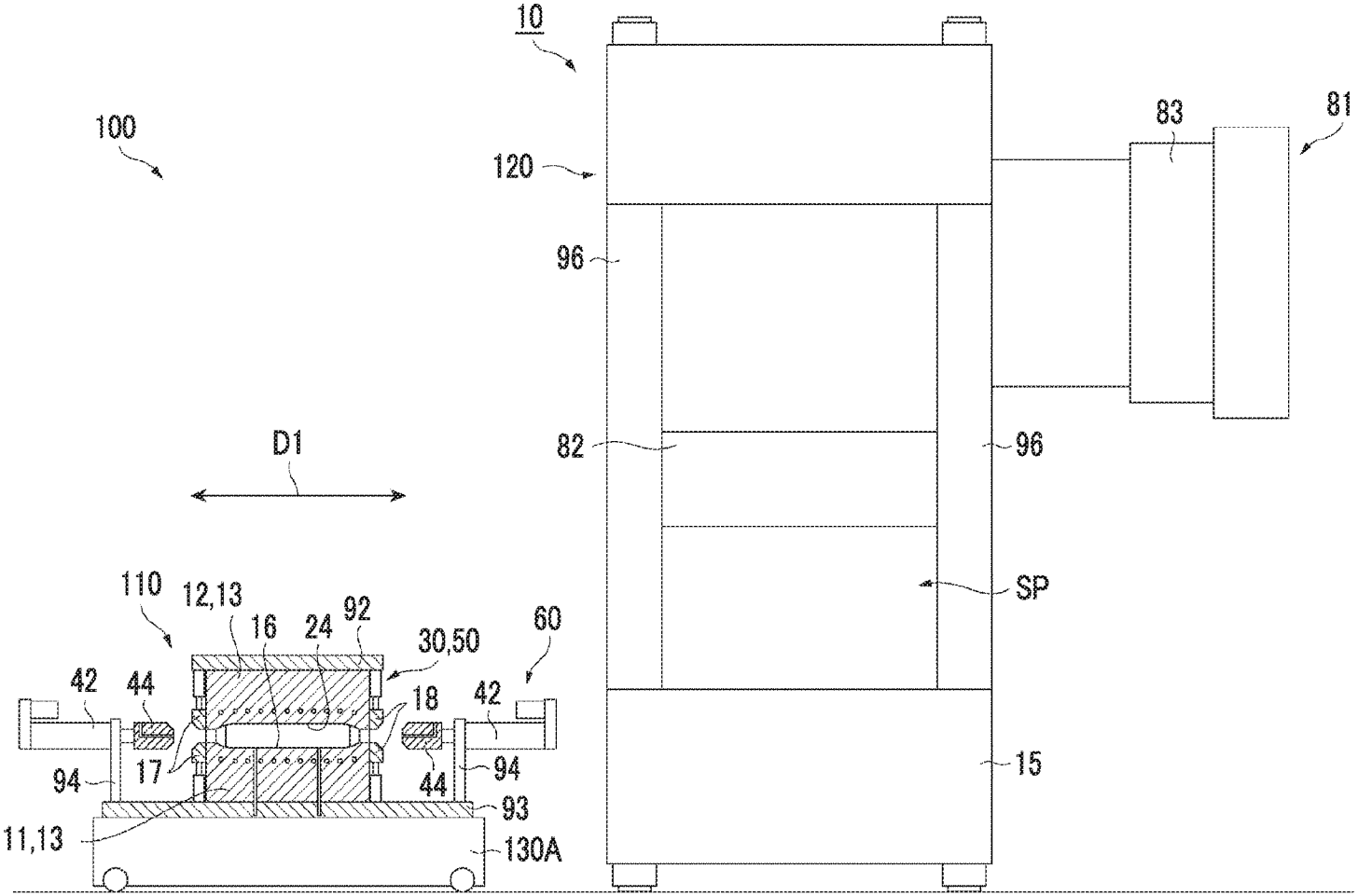
FIG. 6 is a schematic configuration diagram of a replacement system for replacing components of the molding apparatus.

Next, a configuration for replacing a component such as the mold of the molding apparatus 10 will be described with reference to FIGS. 1, 6, and 7. In the molding apparatus 10 according to this embodiment, a replacement unit 110 is replaceably provided with respect to a main body unit 120. That is, in a case of replacing a component such as the mold, by removing the entire replacement unit 110 from the main body unit 120 and assembling a new replacement unit 110 to the main body unit 120, it is possible to easily perform replacement of the component.

The main body unit 120 is provided with the base (a bed) 15, a top section (a crown) 97, frames (tie rods) 96 provided at four corners so as to connect the base 15 and the top section 97, the drive unit 81 provided on the top section 97 side, and the slide 82 which moves the upper mold 12 by a driving force which is applied by the drive unit 81. The main body unit 120 is configured of components which do not need to be replaced at the time of mold replacement and can be used in common even in a case where the mold has been replaced. In this embodiment, a space surrounded by the frames 96 of the four corners, which is a space between the upper surface of the base 15 and the lower surface of the slide 82, is secured as a disposition space SP for disposing and fixing the replacement unit 110.

The replacement unit 110 is configured of at least the lower mold 11, the upper mold 12, the pipe holding mechanism 30 (in this embodiment, the pipe holding mechanism 30 also functions as the heating mechanism 50), the blowing mechanism 60, and the base member 93 to which the blowing mechanism 60 and the mold are connected. The replacement unit 110 is replaceably provided with respect to the main body unit 120 of the molding apparatus 10. The replacement unit 110 is configured of components which need to be replaced at the time of mold replacement. However, with respect to components in which although it is not necessarily essential to be replaced at the time of mold replacement, it is advantageous in terms of the efficiency of replacement work and a cost to be replaced as the replacement unit 110, rather than being left to the main body unit 120 as common components, the components may be components of the replacement unit 110. In the replacement unit 110, the lower mold 11, the pipe holding mechanism 30 (particularly, the first and second electrodes 17 and 18 on the lower side), and the blowing mechanism 60 are connected to the base member 93. Specifically, the lower mold 11 and the first and second electrodes 17 and 18 on the lower side are fixed to the upper surface of the base member 93. Further, the cylinder unit 42 and the seal member 44 of the blowing mechanism 60 are fixed to the base member 93 through the fixing member 94. Further, the upper mold 12 and the first and second electrodes 17 and 18 on the upper side are fixed to the lower surface of the die holder 92. Further, the lower mold 11 and the like fixed to the base member 93 and the upper mold 12 and the like fixed to the die holder 92, of the replacement unit 110, are connected to each other by pins, bolts, or the like by using a fixing tool before assembling thereof to the main body unit 120. In this way, the upper mold 12 can be prevented from being shifted and fallen from the lower mold 11 at the time of transportation of the replacement unit 110. However, in a case where the upper mold 12 has sufficient weight and thus a possibility that the upper mold 12 may be shifted and fallen is low, transportation may be performed in a state where the upper mold 12 is placed on the lower mold 11.

An extension direction of the metal pipe material 14 when the metal pipe material 14 is disposed in the blow molding mold 13 (that is, a direction in which the first electrode 17 and the second electrode 18 face each other) is set to be a "length direction D1", and a direction orthogonal to the length direction D1 when viewed in a planar view is set to be a "width direction D2". In this case, the base member 93 is configured of a rectangular plate member which extends in the length direction D1 when viewed in a planar view. The size in the width direction D2 of the base member 93 is not particularly limited. However, in this embodiment, the size in the width direction D2 of the base member 93 is set to a size greater than or equal to the size in the width direction D2 of the blow molding mold 13. Further, the size in the width direction D2 of the base member 93 may be set to be smaller than the size in the width direction D2 of the upper surface of the base 15 of the main body unit 120 and the width of a space between the frames 96 facing each other in the width direction D2. In this way, it becomes possible to dispose the replacement unit 110 on the base 15 through the space between the frames 96 facing each other in the width direction D2. On the other hand, the size in the length direction D1 of the base member 93 is not particularly limited. However, in this embodiment, the base member 93 is larger than the blow molding mold 13 and protrudes further toward the outside than both end portions in the length direction D1 of the blow molding mold 13. Further, in this embodiment, the size in the length direction D1 of the base member 93 is smaller than the size in the length direction D1 of the base 15. The blowing mechanism 60 is fixed to the protruding portion. Further, the cylinder unit 42 of the blowing mechanism 60 extends further toward the outside than end portions in the length direction D1 of the base member 93 and the base 15.

Next, the configuration of a replacement system 100 having a mechanism for replacing components of the molding apparatus 10, and a component replacement method using the replacement system 100 will be described. The replacement system 100 is provided with the molding apparatus 10 described above, and a first dolly 130A for transporting the replacement unit 110 of the molding apparatus 10. The first dolly 130A is movable along a pair of rails 131 laid in the vicinity of the molding apparatus 10. For description, end portions facing each other in the length direction D1 of the molding apparatus 10 when viewed in a planar view (in the state shown in FIG. 7) are set to be end portions 10*a* and 10*b*, and end portions facing each other in the width direction D2 of the molding apparatus 10 are set to be end portions 10*c* and 10*d*. The rails 131 extend along the length direction D1 from the end portion 10*a* on one side in the length direction D1 of the molding apparatus 10 so as to become more distant from the molding apparatus 10. Accordingly, the first dolly 130A can reciprocate between a first position PG1 close to the position on the near side of the end portion 10*a* of the molding apparatus 10, and a second position PG2 away from the molding apparatus 10.

The method for replacing components of the molding apparatus 10 according to this embodiment using the replacement system 100 described above will be described. However, the order of the steps may be appropriately changed as necessary. First, after the molding in the molding apparatus 10 is ended, the first dolly 130A is moved to the first position PG1 close to the molding apparatus 10. Next, a step of removing the existing replacement unit 110 provided with respect to the main body unit 120 is executed. In this case, the fixing of the replacement unit 110 to the main body unit 120 is released and the replacement unit 110 is transferred from the main body unit 120 to the first dolly 130A by a crane or the like. Next, a step of recovering the removed replacement unit 110 by transporting it to the second position PG2 by the first dolly 130A is executed. After the recovered replacement unit 110 is unloaded from the first dolly 130A by the crane or the like, a new replacement unit 110 is loaded on the first dolly 130A. Next, a step of transporting the new replacement unit 110 from the second position PG2 to the first position PG1 by the first dolly 130A is executed. After the first dolly 130A is moved to the first position PG1, a step of providing the new replacement unit 110 in the main body unit 120 by the crane or the like is executed. In this case, the replacement unit 110 is disposed in the disposition space SP. Further, the base member 93 of the replacement unit 110 is fixed to the upper surface of the base 15 by bolts or the like and the die holder 92 is fixed to the lower surface of the slide 82 by bolts or the like. By the above, the replacement of the replacement unit 110 is completed.

Next, the operation and effects of the molding apparatus 10 according to this embodiment will be described.

First, in a case of changing the shape of a molding product in the molding apparatus, it is necessary to replace the mold. Further, in a case of replacing the mold, other components of the surroundings of the mold also need to be replaced accordingly. In a molding apparatus of the related art, the replacement of a mold and the replacement of other components of the surroundings of the mold are performed as separate working steps. Therefore, a problem in which a lot of time is required for replacement of components occurs.

In contrast, in the molding apparatus 10 according to this embodiment, the replacement unit 110 is replaceably provided with respect to the main body unit 120 having at least the drive unit 81. Further, the replacement unit 110 is configured of at least the blowing mechanism 60 and the blow molding mold 13. Due to such a configuration, when replacing the mold of the molding apparatus 10, it is possible to replace every replacement unit 110 with respect to the main body unit 120. The blowing mechanism 60 or the like, which needs to be replaced according to the mold replacement, can also be replaced. By the above, it is possible to perform replacement of components in a short time.

Further, in the molding apparatus 10 according to this embodiment, in the replacement unit 110, the blowing mechanism 60 and the blow molding mold 13 are connected to the base member 93. Due to such a configuration, it is possible to unitize each component in a simple configuration.

In the method for replacing components of the molding apparatus 10 according to this embodiment, the replacement unit 110 is configured of at least the blowing mechanism 60 and the mold 13 and the replacement unit 110 provided with respect to the main body unit 120 having at least the drive unit 81 is replaced. According to the method for replacing components of the molding apparatus 10 according to the present invention, it is possible to obtain the same operation and effects as those of the molding apparatus 10 described above.

Further, the method for replacing components of the molding apparatus 10 according to this embodiment includes a step of removing the replacement unit 110 provided with respect to the main body unit 120, a step of recovering the removed replacement unit 110 by the first dolly 130A, a step of transporting a new replacement unit 110 by the first dolly 130A, and a step of providing the new replacement unit 110 in the main body unit 120. In this way, it becomes possible to replace the replacement unit 110 by using a single dolly, and therefore, it is possible to replace the replacement unit 110 with a simple system configuration.

Further, the replacement unit 110 according to this embodiment is configured of at least the blowing mechanism 60, the blow molding mold 13, and the base member 93. Due to such a configuration, when replacing the mold of the molding apparatus 10, it is possible to replace every replacement unit 110 with respect to the main body unit 120. The blowing mechanism 60 which needs to be replaced according to the mold replacement can also be replaced. By the above, it is possible to perform replacement of components in a short time.

The present invention is not limited to the embodiment described above.

Figure 7:
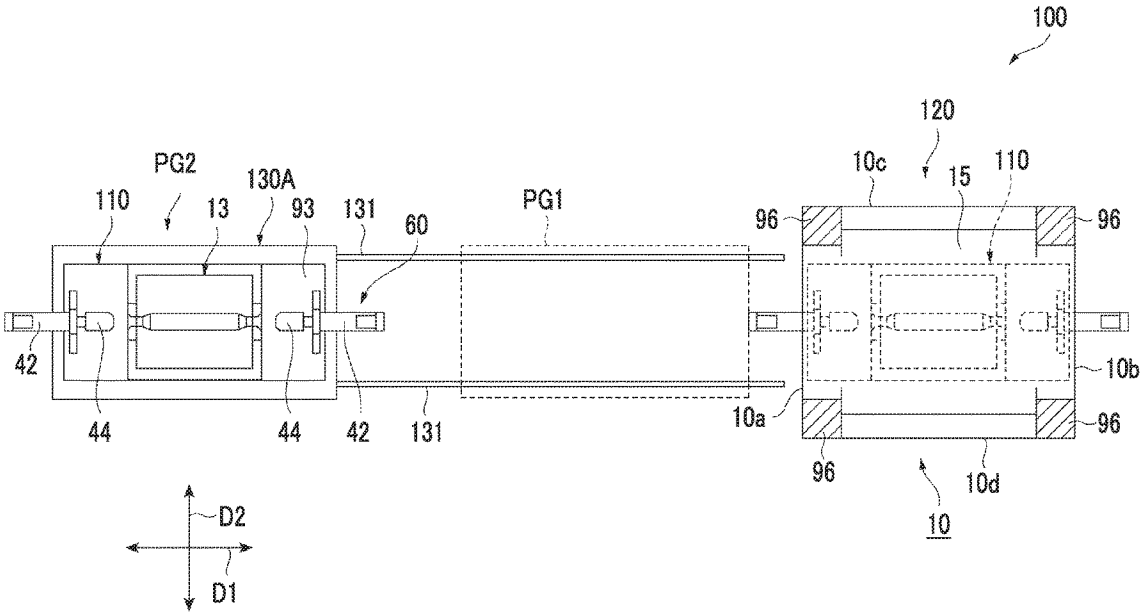
FIG. 7 is a schematic plan view of the replacement system for replacing components of the molding apparatus.
Figure 8:
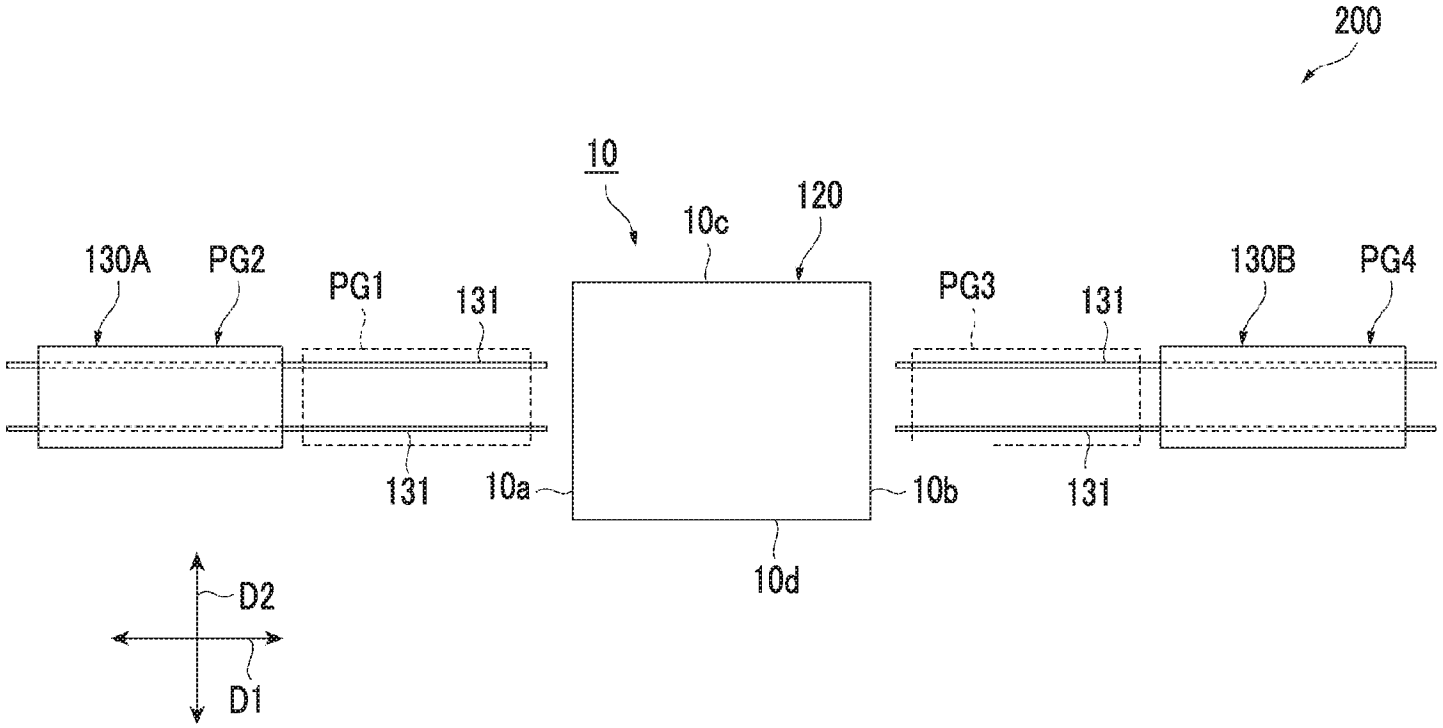
FIG. 8 is a schematic plan view of a replacement system according to a modification example.

For example, the replacement system 100 shown in FIG. 7 is provided with a single dolly. However, the replacement system 100 may be provided with a plurality of dollies. For example, as shown in FIG. 8, a replacement system 200 which is provided with two dollies may be adopted. The replacement system 200 is provided with a second dolly 130B in addition to the first dolly 130A of the replacement system 100 described previously. The rails 131 for moving the second dolly 130B extend along the length direction D1 from the end portion 10*b* on the other side in the length direction D1 of the molding apparatus 10 so as to become more distant from the molding apparatus 10. That is, the second dolly 130B is provided on the side opposite to the first dolly 130A. Accordingly, the second dolly 130B can reciprocate between a third position PG3 close to the position on the near side of the end portion 10*b* of the molding apparatus 10, and a fourth position PG4 away from the molding apparatus 10.

A method for replacing components of the molding apparatus 10 according to this embodiment using the replacement system 200 described above will be described. However, the order of the steps may be appropriately changed as necessary. First, after the molding in the molding apparatus 10 is ended, the first dolly 130A is moved to the first position PG1 close to the molding apparatus 10. Next, a step of removing the existing replacement unit 110 provided with respect to the main body unit 120 is executed. In this case, the fixing of the replacement unit 110 to the main body unit 120 is released and the replacement unit 110 is transferred from the main body unit 120 to the first dolly 130A by a crane or the like. Next, a step of recovering the removed replacement unit 110 by transporting it to the second position PG2 by the first dolly 130A is executed. On the other hand, a new replacement unit 110 is loaded on the second dolly 130B by a crane or the like while the replacement unit 110 is recovered by the first dolly 130A, alternatively, in advance. Then, the new replacement unit 110 is transported from the fourth position PG4 to the third position PG3 by the second dolly 130B. Next, a step of providing the new replacement unit 110 in the main body unit 120 by the crane or the like is executed. By the above, the replacement of the replacement unit 110 is completed.

According to the component replacement method using the replacement system 200 shown in FIG. 8, the replacement unit 110 is recovered by the first dolly 130A, and on the other hand, it is possible to transport the new replacement unit 110 by the second dolly 130B and provide the new replacement unit 110 in the main body unit 120. Therefore, it becomes possible to quickly perform the work of replacing the replacement unit 110.

Further, in the molding apparatus 10 described above, the heating mechanism 50 capable of performing heating treatment between the upper and lower molds is provided and the metal pipe material 14 is heated by using Joule heat by energization. However, there is no limitation thereto. For example, a configuration is also acceptable in which heating treatment is performed at a place other than the place between the upper and lower molds and a metallic pipe after the heating is transported into an area between the molds. Further, in addition to the use of Joule heat by energization, radiation heat of a heater or the like may be used, and it is also possible to perform heating by using a high-frequency induction current.

As the high-pressure gas, a non-oxidizing gas or an inert gas such as nitrogen gas or argon gas can be adopted mainly. Although these gases can make generation of an oxidized scale in a metal pipe difficult, these gases are expensive. In this regard, in the case of compressed air, as long as a major problem due to the generation of an oxidized scale is not caused, it is inexpensive, and even if it leaks into the atmosphere, there is no actual harm, and handling is very easy. Therefore, it is possible to smoothly carry out a blowing process.

The blow molding mold may be either of a non-water-cooled mold or a water-cooled mold. However, the non-water-cooled mold needs a long time when reducing the temperature of the mold to a temperature near an ordinary temperature after the end of blow molding. In this regard, in the case of the water-cooled mold, cooling is completed in a short time. Therefore, from the viewpoint of improvement in productivity, the water-cooled mold is preferable.

Further, in the embodiment described above, a configuration in which in the replacement unit, the gas supply unit and the mold are connected to the base member is illustrated. However, there is no limitation to the configuration. For example, a configuration such as using a base member to which the gas supply unit is connected and another base member to which the mold is connected, rather than both the gas supply unit and the mold being connected to a single base member, may be adopted.

It should be understood that the invention is not limited to the above-described embodiment, but may be modified into various forms on the basis of the spirit of the invention. Additionally, the modifications are included in the scope of the invention.

What is claimed is:

1. A molding apparatus that molds a metal pipe, comprising:

a gas supply unit which supplies gas into a heated metal pipe material, thereby expanding the metal pipe material;

a mold which molds the metal pipe by bringing the expanded metal pipe material into contact therewith; and a drive unit which generates a driving force for moving the mold, wherein a replacement unit is replaceably provided with respect to a main body unit having at least the drive unit, and the replacement unit is configured of at least the gas supply unit and the mold, and in the replacement unit, the gas supply unit and the mold are connected to a base member.

2. A method for replacing components of a molding apparatus which includes a gas supply unit which supplies gas into a heated metal pipe material, thereby expanding the metal pipe material, a mold which molds a metal pipe by bringing the expanded metal pipe material into contact therewith, and a drive unit which generates a driving force for moving the mold, the method comprising:

configuring a replacement unit by at least the gas supply unit and the mold; and replacing the replacement unit provided with respect to a main body unit having at least the drive unit, wherein in the replacement unit, the gas supply unit and the mold are connected to a base member.

3. The method for replacing components of a molding apparatus according to claim 2, further comprising:

a step of removing the replacement unit provided with respect to the main body unit;

a step of recovering the removed replacement unit by a first dolly;

a step of transporting a new replacement unit by the first dolly; and a step of providing the new replacement unit in the main body unit.

4. The method for replacing components of a molding apparatus according to claim 2, further comprising:

a step of removing the replacement unit provided with respect to the main body unit;

a step of recovering the removed replacement unit by a first dolly;

a step of transporting a new replacement unit by a second dolly; and a step of providing the new replacement unit in the main body unit.

5. A replacement unit for a molding apparatus, which is used in a molding apparatus that molds a metal pipe, comprising:

a gas supply unit which supplies gas into a heated metal pipe material, thereby expanding the metal pipe material;

a mold which molds the metal pipe by bringing the expanded metal pipe material into contact therewith; and a base member to which the gas supply unit and the mold are connected, wherein the replacement unit is replaceably provided with respect to a main body unit of the molding apparatus, wherein in the replacement unit, the gas supply unit and the mold are connected to a base member.

* * * * *